US005435114A

United States Patent [19]

Moehlenbrock et al.

[11] Patent Number: 5,435,114

[45] Date of Patent: Jul. 25, 1995

[54] AUTOMATED PACKAGING MACHINE AND PACKAGING METHOD

[75] Inventors: Andrew W. Moehlenbrock; Gregory E. McDonald, both of Simpsonville; Howard D. Conner, Mauldin; Joseph E. Owensby, Spartanburg; Frederick A. Dobbins, Lyman; Thomas H. Bagwell, Simpsonville, all of S.C.

[73] Assignee: W. R. Grace & Co.-Conn, Duncan, S.C.

[21] Appl. No.: 108,410

[22] Filed: Aug. 18, 1993

[51] Int. Cl.[6] ..... B65B 31/02

[52] U.S. Cl. ..... 53/434; 53/469; 53/512; 53/570

[58] Field of Search ..... 53/434, 512, 459, 570, 53/571, 384.1, 469, 373.4, 284.7

[56] References Cited

U.S. PATENT DOCUMENTS

| | | | |
|---|---|---|---|
| 3,511,021 | 5/1970 | Lyon | 53/512 |
| 4,027,456 | 6/1977 | Wilson | 53/434 |
| 4,057,951 | 11/1977 | Schneider | 53/55 |
| 4,219,989 | 9/1980 | Andrews | 53/572 |
| 4,221,106 | 9/1980 | Altenpohl et al. | 53/530 |
| 4,270,336 | 6/1981 | Altenpohl et al. | 53/493 |
| 4,352,263 | 10/1982 | Andrews, Jr. | 43/436 |
| 4,418,513 | 12/1983 | Plahm | 53/512 |
| 4,458,380 | 7/1984 | Tendick | 53/529 |
| 4,510,733 | 4/1985 | Hansen | 53/434 |
| 4,580,393 | 4/1986 | Furukawa | 53/512 |
| 4,586,320 | 5/1986 | Takai | 53/512 |
| 4,723,392 | 2/1988 | Takeda | 53/512 |

FOREIGN PATENT DOCUMENTS 3438599 4/1986 Germany .

*Primary Examiner*—Daniel C. Crane
*Attorney, Agent, or Firm*—Mark B. Quatt

[57] ABSTRACT

The present invention relates to an automated packaging machine for packaging poultry products and a method for packing poultry products using the machine. The machine includes a loading station wherein the product is loaded into a bag and a sealing station for closing the bag. A first clamp arrangement is used to capture and control edges of the bag during the loading operation and to move the bag with the product therein to the sealing station. The machine also includes guides for supporting the product during loading, a plunger for breaking the hocks, and a mechanism for introducing a vacuum into the bag before sealing.

22 Claims, 7 Drawing Sheets

FIG. 1(g) (SIDE VIEW)

FIG. 1(g) (END VIEW)

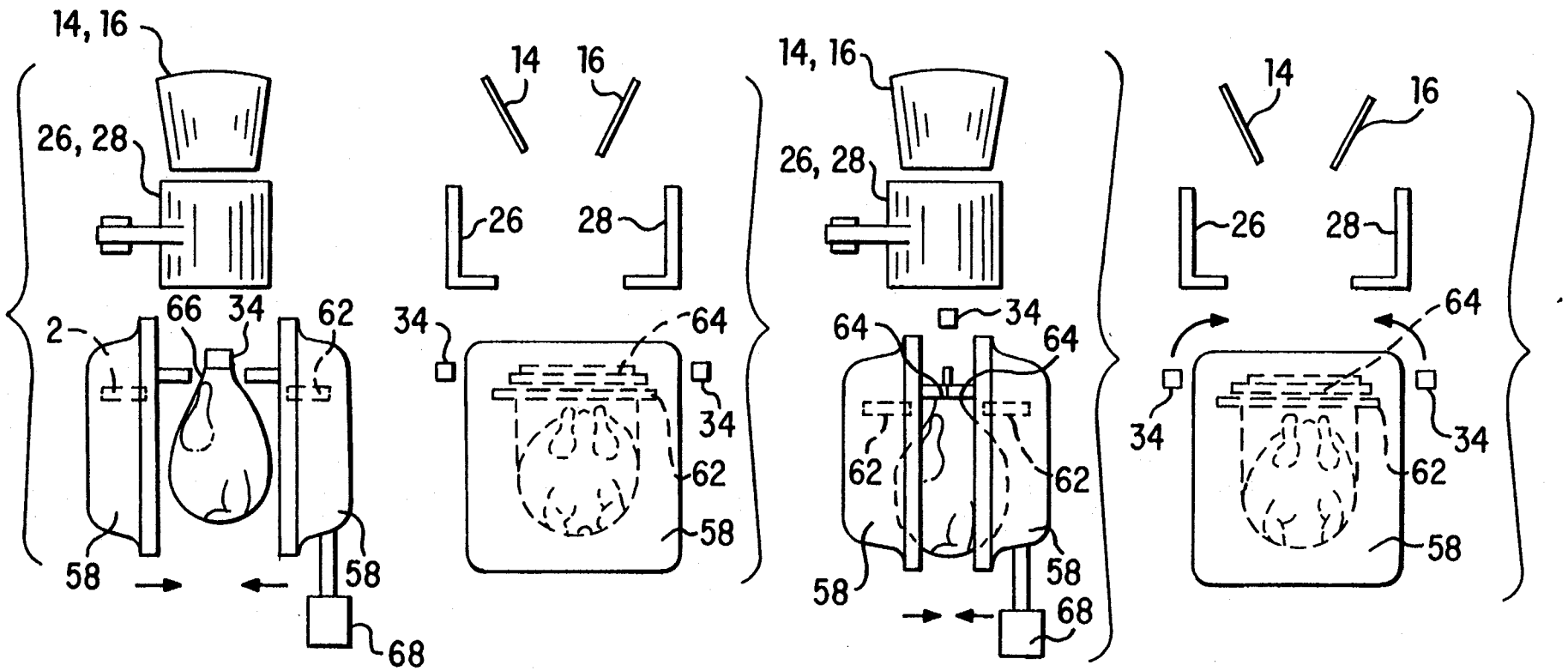
FIG. 1(h) (SIDE VIEW)
FIG. 1(h) (END VIEW)
FIG. 1(i) (SIDE VIEW)
FIG. 1(i) (END VIEW)

(END VIEW)

(SIDE VIEW)

AUTOMATED PACKAGING MACHINE AND PACKAGING METHOD

BACKGROUND OF THE INVENTION

The present invention relates to an automated packaging machine and a method for producing vacuumized and sealed packages and more particularly, to a machine and a method for packaging poultry products.

Automated machines for packaging poultry products such as Cornish hens are known in the art. U.S. Pat. Nos. 4,221,106 and 4,270,336, both to Altenpohl et al., illustrate a plural station bagging system for poultry. In this system, poultry is releasably suspended from a conveyor and is distributed amongst a plurality of stations along a travel path of the conveyor. The bird released from the conveyor is guided into bags which are opened by a nozzle assembly that effects limited expansion of each bag in advance of the entry of each bird into the bag. A ram packs each bird fully into the bag, resulting in tight fit packaging upon withdrawal of the ram and the nozzle assembly from the bag as it is detached and dropped onto a receiving surface.

Another machine for bagging poultry products is illustrated in U.S. Pat. No. 4,219,989 to Andrews. This machine is a stretch bagging apparatus of the type having a reciprocable table top. The machine includes a pair of transversely extensible horns which are advanced axially into an open ended bag supported upon a bag elevator. After the horns advance into the bag, they are transversely extended so as to stretch the bag sides during filling of the bag. After the bag is filled with a chicken or the like, a carriage supporting the table top is axially retracted. This machine is characterized by the provision of a longitudinally reciprocable table top which supports and axially advances both the article being bagged and the transversely extensible horns. The bag elevator includes a pivoted hocking plate valving mechanism which enables the operator to override the packaging system by pushing the filled bag against the hocking plate.

Yet another machine for loading poultry into bags is sold by Artran of Springdale, Ark. The Artran machine can automatically load sixty birds per minute into plastic bags.

U.S. Pat. No. 4,352,263 to Andrews describes an apparatus for packaging poultry in which a chicken carcass is stuffed into a stretch plastic bag. After the carcass has been inserted into the bag with the hocks in an unbroken condition, the hocks are broken by a pusher.

Machines such as the Artran machine and the others described hereinbefore typically have no provision for vacuumizing and sealing the bags after they have been loaded with the birds. As a result, additional machinery and manual labor has to be provided to convey the bagged birds to one or more stations where the bag with the bird therein is vacuumized and then sealed.

SUMMARY OF THE INVENTION

Accordingly, it is an object of the present invention to provide a fully automated packaging machine for packaging products, particularly a poultry product within a bag and thereafter vacuumizing and sealing the bag.

It is a further object of the present invention to provide a machine as described above which allows the number of people needed to package poultry products and the like to be reduced.

It is yet a further object of the present invention to provide a machine as above which reduces the costs associated with packaging poultry products and the like.

Still further, it is an object of the present invention to provide an improved method for packaging poultry products and the like.

The foregoing objects and other advantages are attained by the automated packaging machine and the packaging method of the present invention.

The automated packaging machine of the present invention combines loading, product enhancement, and vacuumizing and sealing operations into one machine unit. It has means for inserting a product particularly, a poultry product, into a bag having an open end, means for holding the bag in an open position while the food product is being inserted therein, and means for vacuumizing and sealing the bag after the product has been inserted therein. The machine further includes means for supporting the product during the loading operation and means for breaking the hocks of the poultry product within the bag prior to the bag being vacuumized and sealed.

The means for holding the bag open in a preferred embodiment comprises product guides and clamp means for capturing and controlling the edges of the bag defining the bag opening. The clamp means are designed with freedom of movement in both the vertical and horizontal planes and after product loading are used to transfer the bag with the product therein to a sealing station located beneath the loading portion of the machine. While the bag is in the proximity of the sealing station, the clamp means maintain the bag neck taut and minimize wrinkles in the bag seal area. This allows a second clamp means in the sealing station to receive the bag allowing the first clamp means to be withdrawn prior to vacuumizing and sealing the bag.

The method for packaging poultry products in accordance with the present invention includes the steps of: providing a bag with an open end, clamping the bag with a first clamping arrangement adjacent edges defining the Open end, moving product support means for supporting the poultry product during insertion of the poultry product into the bag into a supporting position, inserting a poultry product with unbroken hocks into the bag, breaking the hocks of the poultry product, moving the product support means to a retracted position and lowering the bag to a vacuum and sealing station using the first clamping arrangement, grasping the bag with a second clamping arrangement, withdrawing the first clamping arrangement from the vacuum and sealing chamber, and vacuumizing and sealing the bag.

Other details of the machine and method of the present invention are set out in the following description and drawings wherein like reference numerals depict like elements.

DETAILED DESCRIPTION OF A PREFERRED EMBODIMENT(S)

Figures 1A, 1B, 1C, 1D:
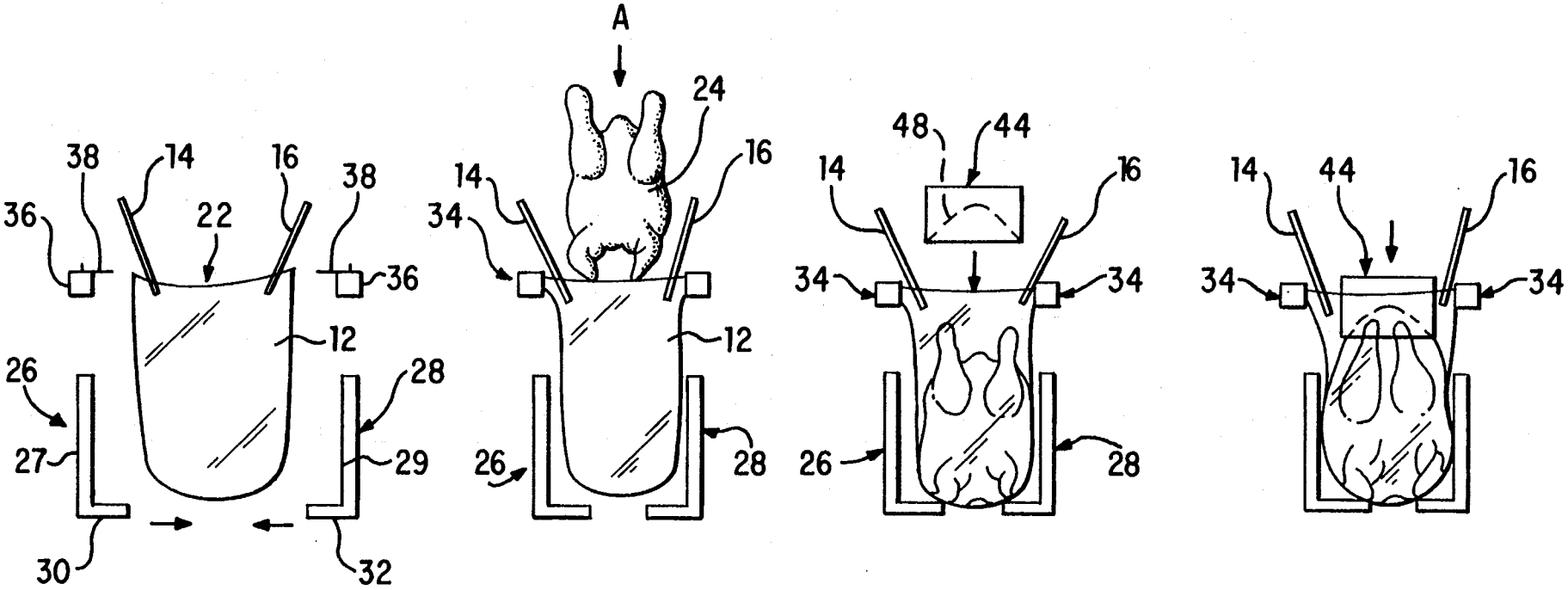
FIGS. 1(*a*)–1(*k*) illustrate the method for packaging a poultry product of the present invention.
Figures 1E, 1F:
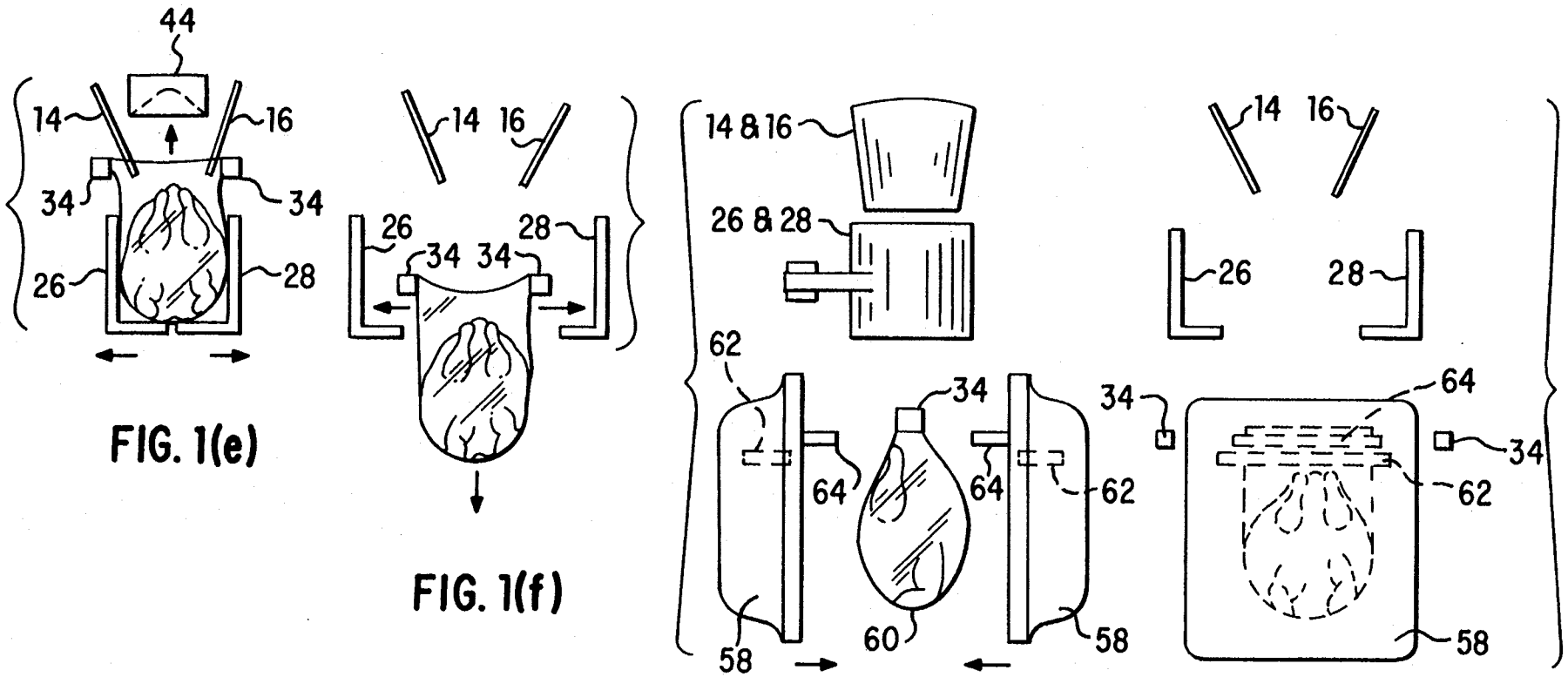
Figure 1K:
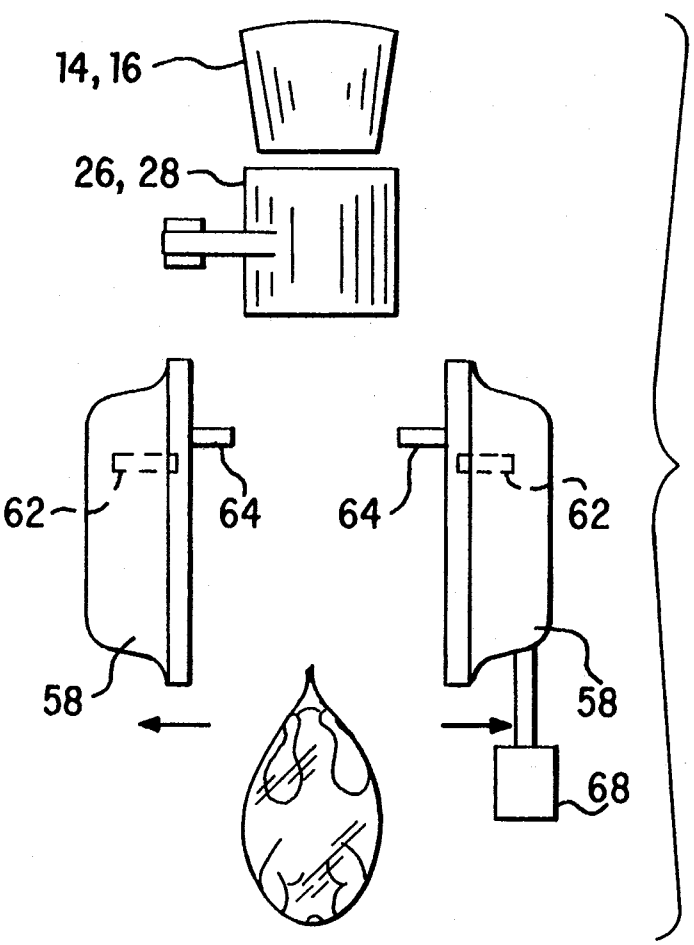
Figure 1J:
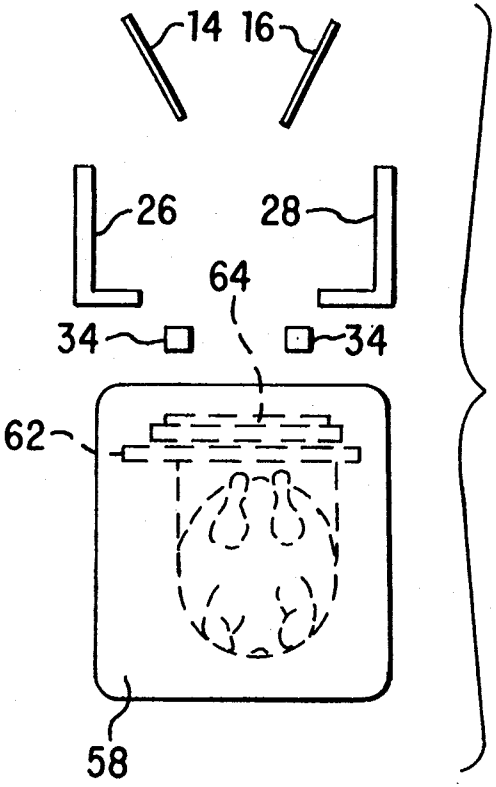
Figure 1J:
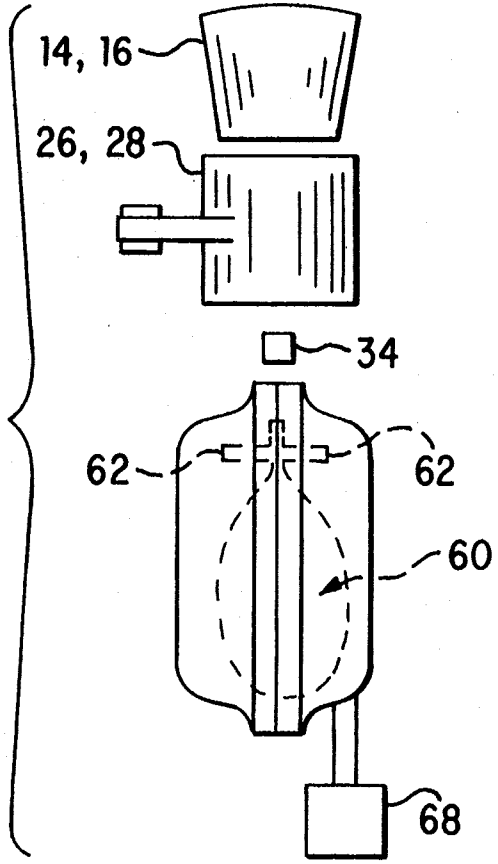
Figure 2:
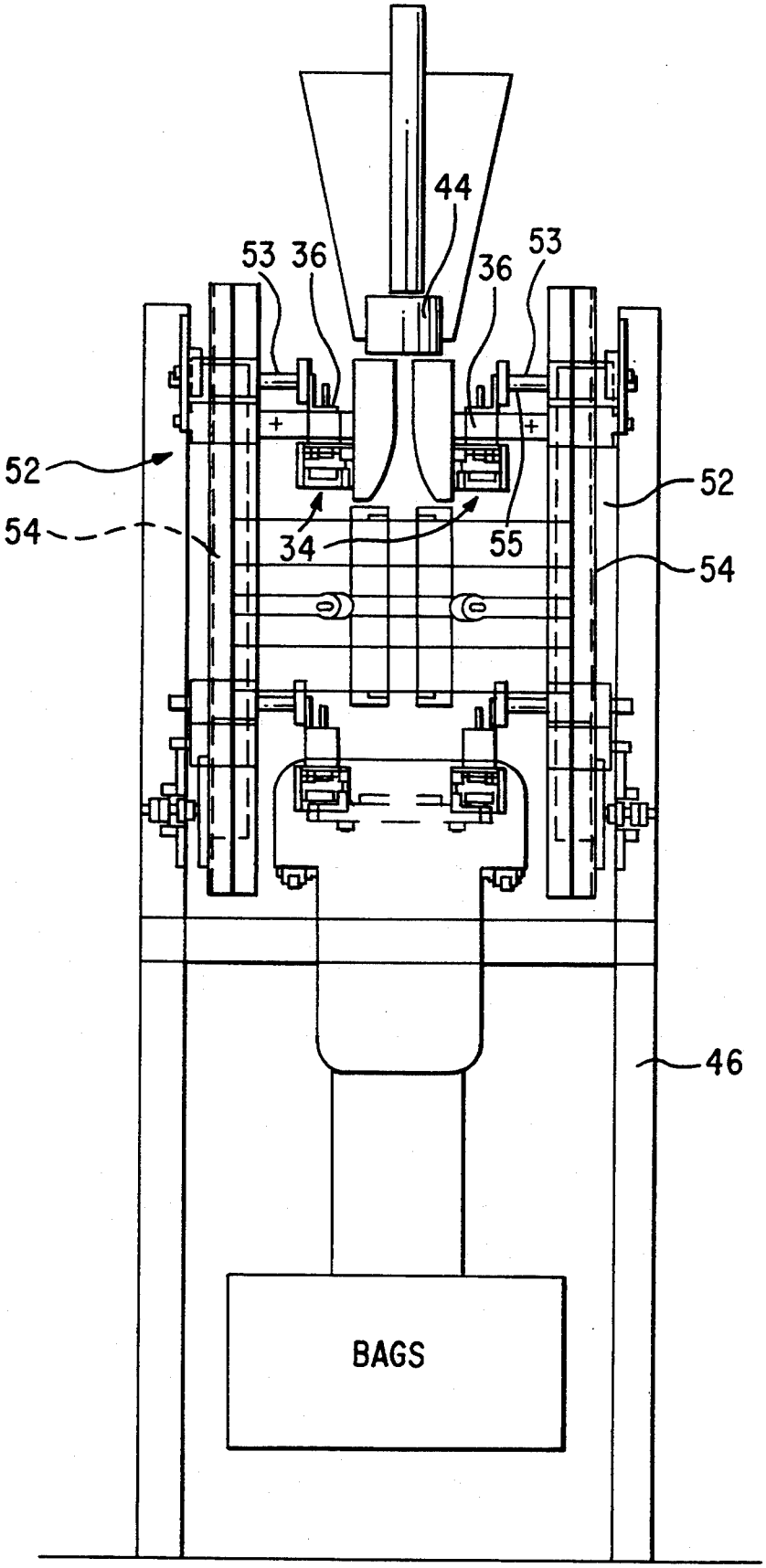
FIG. 2 is a front view of a loading machine incorporating the present invention.
Figure 3:
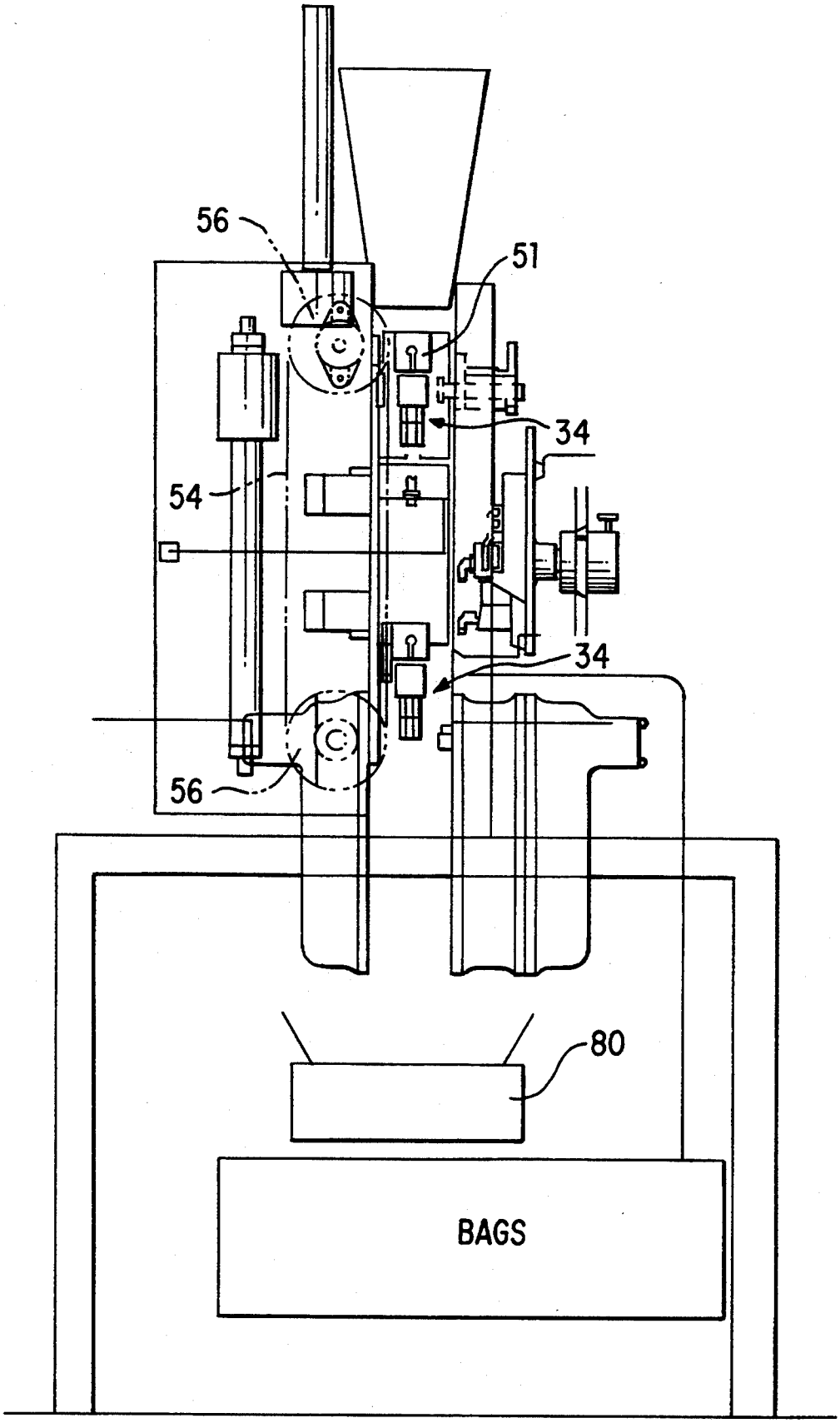
FIG. 3 is a side view of the machine of FIG. 2.

Referring now to the drawings, the automated packaging machine 10 of the present invention has a mechanism (not shown) for holding a plastic bag 12 in a desired location relative to the frame 46 of the machine and an air injection assembly (not shown) for blowing the bag at least partially open. The mechanism for holding the plastic bag in a desired location may comprise any suitable mechanism known in the art. For example, it may be the same mechanism that is used on an Artran packaging machine. Similarly, the air injection assembly may comprise any suitable air injection assembly known in the art. For example, it too may be the same mechanism that is used on existing Cryovac bag loaders or an Artran packaging machine. Other mechanisms known in the art such as vacuum cups may be used for initial bag opening.

The packaging machine 10 further has product guides 14 and 16 which pivot about an axis substantially perpendicular to a loading axis A. The product guides 14 and 16, which may be powered by air cylinders (not shown), enter partially opened end 22 of the bag 12 and assist in inserting the product 24 to be packaged, such as a poultry product with unbroken hocks.

As will be discussed hereinafter, the packaging machine 10 of the present invention contains numerous features which are not found in most prior art machines. For example, the machine 10 is provided with product support guides 26 and 28. The support guides 26 and 28 are each substantially semi-cylindrical in configuration have sidewall portions 27 and 29 and base portions 30 and 32 for supporting the poultry product during loading and a subsequent hock breaking operation. During the hock breaking operation, the base portions 30 and 32 also serve as a hocking plate.

The guides 26 and 28 are supported on a frame (not shown) attached to the frame 46 for movement between a retracted position and a supporting position wherein the guides 26 and 28 substantially abut the bag 12 prior to, during or after the loading of the product 24. The support guides 26 and 28 may be moved between the retracted and supporting positions by an air cylinder arrangement (not shown). When in their supporting position, the guides 26 and 28 may actually abut each other or alternatively, they may be spaced from each other. The relative position of the two guides in the supporting position is a function of the size of the product being packaged.

The machine 10 further includes a first set of clamps 34 for clamping end portions of the bag defining the open end. The clamps 34 capture and control the edges of the bag. While it is preferred that two clamps 34 be used, more than two clamps can be provided if desired.

Figure 4:
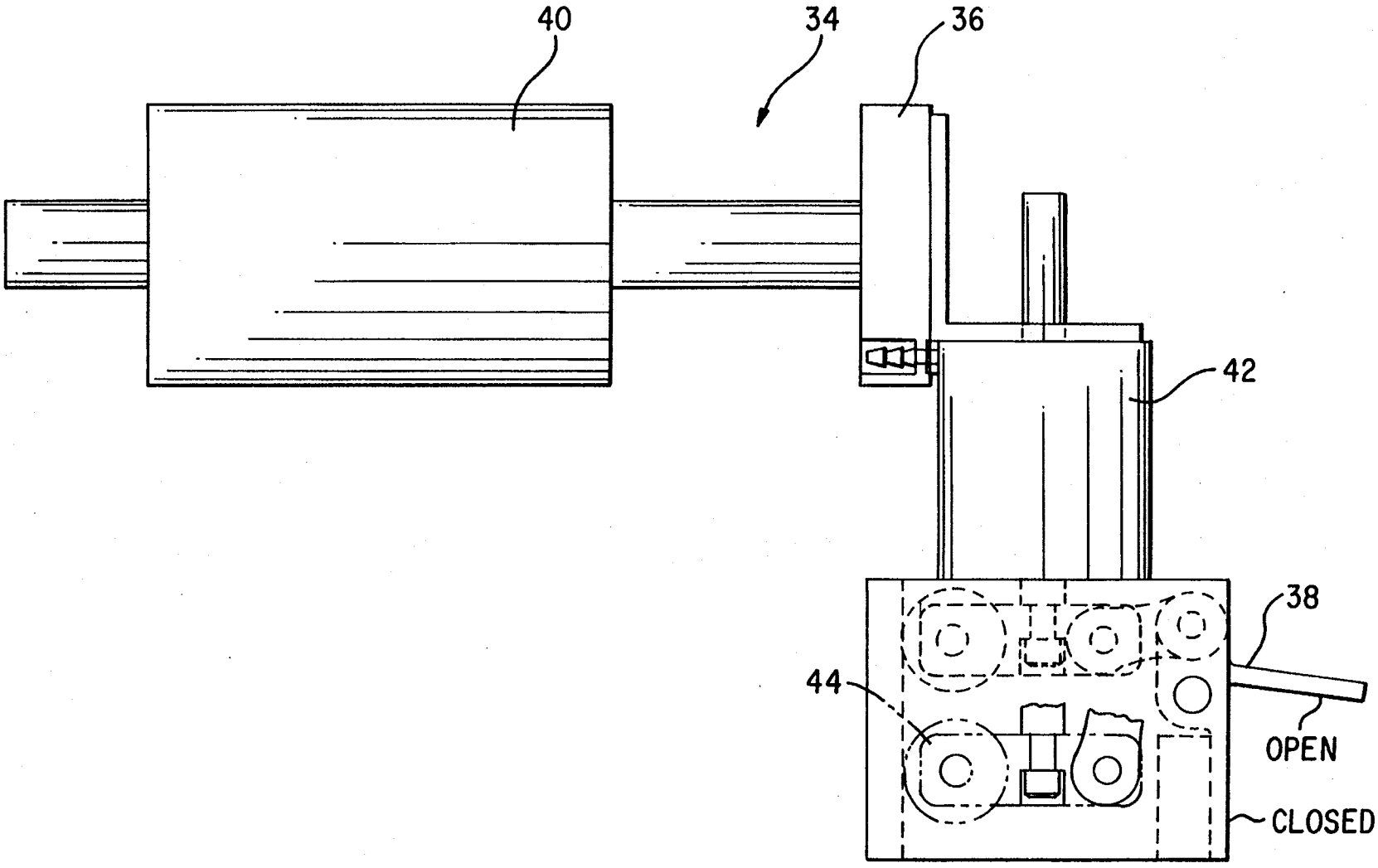
FIG. 4 is a side view of a clamp used with the machine of FIG. 2.

As previously mentioned, clamps 34 are designed to have freedom of movement in two orthogonal planes, i.e. vertical and horizontal planes. With reference to FIG. 4, each clamp 34 includes a base portion 36 which is connected to a transverse motion cylinder 40 for moving the clamps and a finger portion 38 connected to a finger actuation cylinder 42 which moves finger portion 38 between a retracted or open position and a closed position in which it is at least partially inserted into the open end of the bag to clamp the bag during loading and transfer. The finger portion rotates about an axis which is substantially transverse to the loading axis A along which the poultry product is inserted into the bag by means of toggle mechanism 44.

The clamp moving means for each clamp 34 comprises, in the preferred embodiment, a belt and pulley system 52 to which a housing 51 is attached to a belt 54 which travels around pulleys 56, at least one of which is driven by a motor (not shown). A piston-cylinder arrangement 53 is incorporated into the housing 51 and is connected to the base portion 36 by an L-shaped bracket 55. The piston-cylinder arrangement 53 is used to move the base portion 36 and hence the clamp 34 along in a first plane substantially transverse to the product insertion axis A between a retracted position and an engaging position. The piston-cylinder arrangement 53 may be used to hold the bag open with a desired tautness. Movement of each clamp 34 in a second plane transverse to the first plane and parallel to the axis A is accomplished by driving at least one pulley 56 and causing the belt 54 and the housing 51 to move in a direction substantially parallel to the axis A. The clamp moving means may be mounted to the machine frame 46 using any suitable means known in the art.

To allow the clamps 34 to move between the retracted and bag engaging positions, a notch or cut-out portion 40 is provided in each of the product guides 14 and 16 through which finger portion 38 projects.

As previously mentioned, the poultry product is inserted into the bag 12 with its hocks unbroken. Thereafter, a hock breaking plunger 44 is inserted into the bag to compress the legs of the poultry product against the carcass to break the hocks of the poultry product. The hock breaking plunger may also be mounted to the frame 46 of the machine in any desired manner and may be provided it with any suitable ram means (not shown) known in the art to move it between hock breaking and retracted positions.

As shown in FIG. 1(*c*), the hock breaking plunger 44 preferably has a substantially V-shaped or curved surface 48 for contacting the legs of the poultry product. An optional recess portion (not shown) may be provided for receiving a tail portion of the poultry product. After the hocks on the poultry product are broken, the plunger 44 is withdrawn to a retracted position as shown in FIG. 1(*e*). Thereafter, the product support guides 26 and 28 are withdrawn to their retracted position.

The clamps 34 are then used to transfer the bag with the poultry product therein to a sealing station 42 which forms part of the machine 10 and is located below the product support assembly. The clamps 34 are able to move along an axis substantially parallel to the axis in which the poultry product is inserted into the bag by virtue of the aforementioned pulley and belt system 52 attached to the frame 46.

As shown in FIGS. 1(*e*)–1(*k*), the sealing station 42 comprises two translatable shell portions 58 for forming a vacuum chamber 60 and sealing means 62 located within the shells. Each shell portion 58 is preferably in the form of a substantially flattened hemisphere. Any suitable means (not shown) known in the art may be used to move the shell portions 58 between the retracted position shown in FIG. 1(*g*) and the closed position shown in FIG. 1(*j*). In the closed position, the shell portions 58 define a closed space to which a vacuum can be applied.

The sealing station 42 includes a second set of clamps 64 for grasping a neck portion 66 of the bag 12 and for moving the neck portion to a sealing position. The clamps 64 are activated by partial closure of the shells 58. While the clamps 64 are being moved into a position to take over control of the bag 12, the clamps 34 are adjusted to pull the neck 66 of the bag taut minimizing wrinkles in the bag seal area. As shown in FIG 1(*i*), the clamps 34 are withdrawn from the chamber 60 after the clamps 64 have taken control over the bag and its neck portion 66. The clamps 64 may comprise any suitable clamping arrangement known in the art.

The means 62 for sealing the bag 12 are preferably formed by seal bars positioned internally of the shell portions 58. The bars may be straight or curved. If desired, the seal bars may include tooling to cutoff or clip an end portion of the bag after the opening in the bag has been closed and sealed. Any suitable cutoff or clipping tooling known in the art may be incorporated into the seal bars. If desired, the sealing means 62 may comprise a heat sealing device or an ultrasonic sealing device.

The sealing station is also provided with means 68 for evacuating the chamber and for vacuumizing the bag prior to sealing. The vacuumizing means 68 may comprise any suitable means known in the art for vacuumizing a bag with a poultry product therein.

After the vacuumizing and sealing operations have been completed, the shell portions 58 are moved to their retracted position and the sealed bag 12 with the poultry product therein is allowed to drop onto a conveyor 80 or other product collection device.

The present invention is most advantageous in that it integrates into a single automated packaging unit the functions of loading a product into a bag and transferring the bag with the product therein to a vacuum chamber where the product bag is vacuumized and sealed. A transfer mechanism is provided which incorporates therein clamps for spreading the bag neck and minimizing wrinkles therein just prior to the sealing operation. The clamps also acts as a means to register the product location with respect to the seal bar. The transfer mechanism and the registration means are formed by the clamps 34 of the present invention. In addition, the machine of the present invention offers the capability to automatically enhance the product such as by breaking the hocks on the product.

Advantages of the automated packaging machine of the present invention include minimal labor in the form of machine overseers, minimized operating costs for the customer, a more consistent product due to minimal human handling of the product, ergonomic improvements, synchronous or asynchronous product infeed, minimum floor space, and maximum flexibility in providing a machine which meets a variety of production needs.

While the machine of the present invention has been illustrated as having a vertical insertion axis A, the axis could be at some angle to the vertical or could be horizontal. Additionally, the machine could be arranged so that the product would travel from the bottom of the machine to the top of the machine.

It is apparent that there has been provided in accordance with this invention an automated packaging machine which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An automated machine for packaging products, said machine comprising: means for inserting a product into a bag having an open end, said product being inserted along a first axis;

means for holding said bag in an open position while said product is being inserted therein;

said bag holding means including first clamp means for capturing and controlling edges of said bag adjacent said open end, said first clamp means being movable in a first plane substantially transverse to said first axis between a retracted position and a bag engaging position, and having a finger portion which rotates about a second axis substantially transverse to said first axis from a retracted position to an inserted position wherein said finger portion is at least partially inserted into said bag;

means for sealing said bag after said product has been inserted therein; and said first clamp means being used to transfer said bag with said product therein to said sealing means.

2. The machine of claim 1 wherein said product inserting means comprises at least two product guides each pivotable about an axis substantially perpendicular to said first axis, said product guides being at least partially inserted within said bag.

3. The machine of claim 1 further comprising:

means for moving said first clamp means in a second plane substantially parallel to said first axis towards and from said sealing means.

4. The machine of claim 3 wherein said moving means comprises a belt and pulley system for moving said first clamp means in said second plane.

5. The machine of claim 1 further comprising a piston-cylinder arrangement for moving said first clamp means in said first plane.

6. An automated machine for packaging products, said machine comprising: means for inserting a product into a bag having an open end, said product being inserted along a first axis;

means for holding said bag in an open position while said product is being inserted therein;

said bag holding means including first clamp means for capturing and controlling edges of said bag adjacent said open end;

means for sealing said bag after said product has been inserted therein;

said first clamp means being used to transfer said bag with said product therein to said sealing means; and means for supporting said product and said bag as said product is being inserted into said bag, said support means located outside the bag.

7. The machine of claim 6 wherein said product supporting means comprises two substantially semi-cylindrical support members movable between a retracted position and a supporting position.

8. The machine of claim 6 wherein said sealing means is located beneath said supporting means.

9. An automated machine for packaging products, said machine comprising: means for inserting a product into a bag having an open end, said product being inserted along a first axis;

means for holding said bag in an open position while said product is being inserted therein;

said bag holding means including first clamp means for capturing and controlling edges of said bag adjacent said open end;

means for sealing said bag after said product has been inserted therein;

said first clamp means being used to transfer said bag with said product therein to said sealing means;

said product being inserted into said bag comprising a poultry product with unbroken hocks; and means for breaking the hocks of said poultry product.

10. The machine of claim 9 wherein said hock breaking means comprises a plunger which is at least partially inserted within said bag.

11. The machine of claim 10 wherein said plunger has a surface for contacting legs of said poultry product and compressing said legs against a body of said poultry product so as to break said hocks.

12. An automated machine for packaging products, said machine comprising: means for inserting a product into a bag having an open end, said product being inserted along a first axis;

means for holding said bag in an open position while said product is being inserted therein;

said bag holding means including first clamp means for capturing and controlling edges of said bag adjacent said open end;

means for sealing said bag after said product has been inserted therein;

said first clamp means being used to transfer said bag with said product therein to said sealing means;

at least one vacuum chamber formed by two shell portions movable towards and away from each other;

said shell portions in a closed portion defining a closed space to which a vacuum can be applied;

said sealing means located internally of said shell portions; and second clamp means located internally of said shell portions for holding said bag with said product therein in a desired position.

13. The machine of claim 12 further comprising means for cutting an end portion of said bag after said bag has been sealed by said sealing means.

14. The machine of claim 12 wherein said sealing means comprises means for heat sealing said bag.

15. The machine of claim 12 wherein said sealing means comprises an ultrasonic sealing device.

16. The machine of claim 12 wherein said sealing means comprises a clipping device.

17. The machine of claim 12 wherein said sealing means comprises at least two straight sealing bars.

18. The machine of claim 12 wherein said sealing means comprises at least two curved sealing bars.

19. A method for packaging a poultry product which comprises the steps of: providing a bag with an open end;

clamping said bag with a first clamping arrangement at edges defining said open end;

supporting said poultry product during insertion of said poultry product in said bag;

inserting said poultry product in said bag;

providing means for vacuumizing and sealing said bag;

moving said bag into said means for evacuating using said first clamping arrangement; and breaking hocks of said poultry product by inserting a plunger into said bag; wherein said clamping step comprises moving said first clamping arrangement along a first axis between a retracted position and a bag engaging position; and said moving step comprises moving said first clamping arrangement along a second axis substantially perpendicular to said first axis.

20. A method for packaging a poultry product which comprises the steps of: providing a bag with an open end;

clamping said bag with a first clamping arrangement at edges defining said open end;

supporting said poultry product during insertion of said poultry product in said bag;

inserting said poultry product in said bag;

providing means for vacuumizing and sealing said bag;

moving said bag into said means for evacuating using said first clamping arrangement;

grasping said bag with a second clamping arrangement after said bag has been moved into said chamber; and withdrawing said first clamping arrangement after said grasping step; subjecting said bag with said poultry product therein to a vacuum; and sealing said bag.

21. A method for packaging a product which comprises the steps of: providing a bag with an open end;

clamping said bag with a first clamping arrangement at edges defining said open end;

supporting said product during insertion of said product in said bag;

inserting said product in said bag;

providing means for vacuumizing and sealing said bag;

moving said bag into said means for evacuating using said first clamping arrangement; and breaking hocks of said product by inserting a plunger into said bag; wherein said clamping step comprises moving said first clamping arrangement along a first axis between a retracted position and a bag engaging position; and said moving step comprises moving said first clamping arrangement along a second axis substantially perpendicular to said first axis.

22. A method for packaging a product which comprises the steps of:

providing a bag with an open end;

clamping said bag with a first clamping arrangement at edges defining said open end;

supporting said product during insertion of said product in said bag;

inserting said product in said bag;

providing means for vacuumizing and sealing said bag;

moving said bag into said means for evacuating using said first clamping arrangement;

grasping said bag with a second clamping arrangement after said bag has been moved into said chamber;

withdrawing said first clamping arrangement after said grasping step;

subjecting said bag with said product therein to a vacuum; and sealing said bag.

* * * * *